US011790863B2

(12) United States Patent
Xiao

(10) Patent No.: US 11,790,863 B2
(45) Date of Patent: Oct. 17, 2023

(54) COMPENSATION METHOD OF DISPLAY PANEL AND COMPENSATION DEVICE THEREOF

(71) Applicant: TCL China Star Optoelectronics Technology Co., Ltd., Guangdong (CN)

(72) Inventor: Guangxing Xiao, Guangdong (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 348 days.

(21) Appl. No.: 17/263,566

(22) PCT Filed: Dec. 28, 2020

(86) PCT No.: PCT/CN2020/140250
§ 371 (c)(1),
(2) Date: Jan. 27, 2021

(87) PCT Pub. No.: WO2022/116330
PCT Pub. Date: Jun. 9, 2022

(65) Prior Publication Data

US 2022/0398988 A1 Dec. 15, 2022

(30) Foreign Application Priority Data

Dec. 2, 2020 (CN) ..... 202011403382.4

(51) Int. Cl.
*G09G 3/36* (2006.01)

(52) U.S. Cl.
CPC ... *G09G 3/3607* (2013.01); *G09G 2320/0233* (2013.01); *G09G 2320/0271* (2013.01)

(58) Field of Classification Search
CPC .. G09G 3/3607; G09G 3/3406; G09G 3/3611; G09G 3/3413; G09G 2320/0233; G09G 2320/0271; G09G 2320/0666
See application file for complete search history.

(56) References Cited

U.S. PATENT DOCUMENTS

| | | | | |
|---|---|---|---|---|
| 7,292,213 | B2 | 11/2007 | Shen | |
| 2019/0384561 | A1 | 12/2019 | Jung | |
| 2020/0013348 | A1* | 1/2020 | Lee | G09G 3/3406 |
| 2022/0383829 | A1* | 12/2022 | Xi | G02F 1/1347 |

FOREIGN PATENT DOCUMENTS

| | | |
|---|---|---|
| CN | 1835587 | 9/2006 |
| CN | 101286300 | 10/2008 |
| CN | 103218961 | 7/2013 |
| CN | 104966493 | 10/2015 |

(Continued)

*Primary Examiner* — David Tung

(57) ABSTRACT

A compensation method of a display panel and a compensation device thereof are provided. The compensation method of the display panel includes following steps: determining location information of a pixel to be compensated and acquiring a first image parameter under a first reference grayscale and a second image parameter under a second reference grayscale of a panel to be compensated; determining a target compensation value of the pixel to be compensated under a target grayscale; and determining compensation brightness of the pixel to be compensated under the target grayscale according to the target compensation value.

7 Claims, 3 Drawing Sheets

(56) References Cited

FOREIGN PATENT DOCUMENTS

| | | |
|---|---|---|
| CN | 104992657 | 10/2015 |
| CN | 107248389 | 10/2017 |
| CN | 107591120 | 1/2018 |
| CN | 107610143 | 1/2018 |
| CN | 110189721 | 8/2018 |
| CN | 111292701 | 6/2020 |
| CN | 111540309 | 8/2020 |

* cited by examiner

COMPENSATION METHOD OF DISPLAY PANEL AND COMPENSATION DEVICE THEREOF

RELATED APPLICATIONS

This application is a National Phase of PCT Patent Application No. PCT/CN2020/140250 having International filing date of Dec. 28, 2020, which claims the benefit of priority of Chinese Patent Application No. 202011403382.4 filed on Dec. 2, 2020. The contents of the above applications are all incorporated by reference as if fully set forth herein in their entirety.

FIELD AND BACKGROUND OF INVENTION

The present disclosure relates to the field of display technologies, and more particularly, to a compensation method of a display panel and a compensation device thereof.

With increased demands for display panel products, thinning while reducing production cost is a big development direction for display panels. Wherein, applying mini-light-emitting diodes (mini-LEDs) to liquid crystal display panels, which have more advantages in cost than organic light-emitting diodes (OLEDs) while thinning the display panels, therefore, receives widespread attention.

At present, due to spliced backlight sources, liquid crystal display devices using the mini-light-emitting diodes have problems of nonuniform display brightness at splicing locations in display panels, which affects display quality of the display panels.

Therefore, it is necessary to provide a new compensation method of a display panel and a compensation device thereof to solve the above problems.

Technical problem: the present disclosure provides the compensation method of the display panel and the compensation device thereof to solve the problems of nonuniform display brightness at the splicing locations in the display panels of the liquid crystal display devices using the mini-light-emitting diodes due to the spliced backlight sources and causing the display quality of the display devices to be affected.

SUMMARY OF THE INVENTION

The present disclosure provides a compensation method of a display panel, which includes following steps: acquiring an original image parameter of a panel to be compensated under a target grayscale and determining location information of a pixel to be compensated of the panel to be compensated according to the original image parameter;

acquiring a first image parameter under a first reference grayscale and a second image parameter under a second reference grayscale of the panel to be compensated;

determining a target compensation value of the pixel to be compensated under the target grayscale according to the location information of the pixel to be compensated, the first image parameter, and the second image parameter; and determining compensation brightness of the pixel to be compensated under the target grayscale according to the target compensation value.

In the compensation method of the display panel provided by the present disclosure, the step of acquiring the original image parameter of the panel to be compensated under the target grayscale and determining the location information of the pixel to be compensated of the panel to be compensated according to the original image parameter includes:

acquiring first location information of any one of pixels when the panel to be compensated displays white light under the target grayscale and determining the location information of the pixel to be compensated of the panel to be compensated according to the first location information.

In the compensation method of the display panel provided by the present disclosure, the step of acquiring the first image parameter under the first reference grayscale and the second image parameter under the second reference grayscale of the panel to be compensated includes:

acquiring a first reference white light compensation value of at least one first reference pixel when the panel to be compensated displays the white light under the first reference grayscale; and acquiring a second reference white light compensation value of at least one second reference pixel when the panel to be compensated displays the white light under the second reference grayscale.

In the compensation method of the display panel provided by the present disclosure, the step of determining the target compensation value of the pixel to be compensated under the target grayscale according to the location information of the pixel to be compensated, the first image parameter, and the second image parameter includes:

acquiring a first white light compensation value corresponding to the pixel to be compensated under the first reference grayscale according to the location information of the pixel to be compensated and the first reference white light compensation value;

acquiring a second white light compensation value corresponding to the pixel to be compensated under the second reference grayscale according to the location information of the pixel to be compensated and the second reference white light compensation value; and performing first linear interpolation according to the first white light compensation value and the second white light compensation value to acquire a target white light compensation value of the pixel to be compensated under the target grayscale;

wherein a formula of the first linear interpolation is:

$$y = \frac{y2 * (x1 - x)}{x1 - x2} + \frac{y1 * (x - x2)}{x1 - x2};$$

wherein x1 and x2 denote the first reference grayscale and the second reference grayscale, y1 and y2 denote the first white light compensation value and the second white light compensation value, x denotes the target grayscale, and y denotes the target white light compensation value.

In the compensation method of the display panel provided by the present disclosure, the step of acquiring the first white light compensation value corresponding to the pixel to be compensated under the first reference grayscale according to the location information of the pixel to be compensated and the first reference white light compensation value includes:

acquiring first reference white light compensation values corresponding to at least two first reference pixels in a same row or same column with the pixel to be compensated according to the location information of the pixel to be compensated; and performing second linear interpolation according to the first reference white light compensation values corresponding to the at least two first reference pixels in the same row or same column with the pixel to be compensated to acquire the first white light compensation value corresponding to the pixel to be compensated under the first reference grayscale;

wherein a formula of the second linear interpolation is:

$$b = \frac{b2*(a1-a)}{a1-a2} + \frac{b1*(a-a2)}{a1-a2};$$

wherein a1 and a2 denote row count values or column count values of two first reference pixels in a same row or same column with the pixel to be compensated, b1 and b2 denote the first reference white light compensation values corresponding to the two first reference pixels in the same row or same column with the pixel to be compensated, a denotes a row count value or a column count value of the pixel to be compensated, and b denotes the first white light compensation value.

In the compensation method of the display panel provided by the present disclosure, the step of acquiring the second white light compensation value corresponding to the pixel to be compensated under the second reference grayscale according to the location information of the pixel to be compensated and the second reference white light compensation value includes:

acquiring second reference white light compensation values corresponding to at least two second reference pixels in a same row or same column with the pixel to be compensated according to the location information of the pixel to be compensated; and performing third linear interpolation according to the second reference white light compensation values corresponding to the at least two second reference pixels in the same row or same column with the pixel to be compensated to acquire the second white light compensation value corresponding to the pixel to be compensated under the second reference grayscale;

wherein a formula of the third linear interpolation is:

$$n = \frac{n2*(m1-m)}{m1-m2} + \frac{n1*(m-m2)}{m1-m2};$$

wherein m1 and m2 denote row count values or column count values of two second reference pixels in a same row or same column with the pixel to be compensated, n1 and n2 denote the second reference white light compensation values corresponding to the two second reference pixels in the same row or same column with the pixel to be compensated, m denotes a row count value or a column count value of the pixel to be compensated, and n denotes the second white light compensation value.

In the compensation method of the display panel provided by the present disclosure, the step of acquiring the original image parameter of the panel to be compensated under the target grayscale and determining the location information of the pixel to be compensated of the panel to be compensated according to the original image parameter includes:

acquiring second location information of any one of red sub-pixels when the panel to be compensated displays red light under the target grayscale and determining location information of a red sub-pixel to be compensated of the panel to be compensated according to the second location information;

acquiring third location information of any one of green sub-pixels when the panel to be compensated displays green light under the target grayscale and determining location information of a green sub-pixel to be compensated of the panel to be compensated according to the third location information; and acquiring fourth location information of any one of blue sub-pixels when the panel to be compensated displays blue light under the target grayscale and determining location information of a blue sub-pixel to be compensated of the panel to be compensated according to the fourth location information.

In the compensation method of the display panel provided by the present disclosure, the step of acquiring the first image parameter under the first reference grayscale and the second image parameter under the second reference grayscale of the panel to be compensated includes:

acquiring a first reference red light compensation value of at least one of the red sub-pixels when the panel to be compensated displays the red light under the first reference grayscale, acquiring a first reference green light compensation value of at least one of the green sub-pixels when the panel to be compensated displays the green light under the first reference grayscale, and acquiring first reference blue light compensation values of at least two of the blue sub-pixels when the panel to be compensated displays the blue light under the first reference grayscale;

acquiring a second reference red light compensation value of at least one of the red sub-pixels when the panel to be compensated displays the red light under the second reference grayscale, acquiring a second reference green light compensation value of at least one of the green sub-pixels when the panel to be compensated displays the green light under the second reference grayscale, and acquiring a second reference blue light compensation value of at least one of the blue sub-pixels when the panel to be compensated displays the blue light under the second reference grayscale.

In the compensation method of the display panel provided by the present disclosure, the step of determining the target compensation value of the pixel to be compensated under the target grayscale according to the location information of the pixel to be compensated, the first image parameter, and the second image parameter includes:

acquiring a first red light compensation value corresponding to the red sub-pixel to be compensated under the first reference grayscale according to the location information of the red sub-pixel to be compensated and the first reference red light compensation value, acquiring a first green light compensation value corresponding to the green sub-pixel to be compensated under the first reference grayscale according to the location information of the green sub-pixel to be compensated and the first reference green light compensation value, and acquiring a first blue light compensation value corresponding to the blue sub-pixel to be compensated under the first reference grayscale according to the location information of the blue sub-pixel to be compensated and the first reference blue light compensation value;

acquiring a second red light compensation value corresponding to the red sub-pixel to be compensated under the second reference grayscale according to the location information of the red sub-pixel to be compensated and the second reference red light compensation value, acquiring a second green light compensation value corresponding to the green sub-pixel to be compensated under the second reference grayscale according to the location information of the green sub-pixel to be compensated and the second reference green light compensation value, and acquiring a second blue light compensation value corresponding to the blue sub-pixel to be compensated under the second reference grayscale according to the location information of the blue sub-pixel to be compensated and the second reference blue light compensation value; and performing fourth linear interpolation according to the first red light compensation value and the second red light compensation value to acquire a target red light compensation value of the red sub-pixel to be compensated under the target grayscale, performing fifth linear interpolation according to the first green light compensation value and the second green light compensation value to acquire a target green light compensation value of the green sub-pixel to be compensated under the target grayscale, and performing sixth linear interpolation according to the first blue light compensation value and the second blue light compensation value to acquire a target blue light compensation value of the blue sub-pixel to be compensated under the target grayscale.

In thee compensation method of the display panel provided by the present disclosure, the step of acquiring the first red light compensation value corresponding to the red sub-pixel to be compensated under the first reference grayscale according to the location information of the red sub-pixel to be compensated and the first reference red light compensation value, acquiring the first green light compensation value corresponding to the green sub-pixel to be compensated under the first reference grayscale according to the location information of the green sub-pixel to be compensated and the first reference green light compensation value, and acquiring the first blue light compensation value corresponding to the blue sub-pixel to be compensated under the first reference grayscale according to the location information of the blue sub-pixel to be compensated and the first reference blue light compensation value includes:

acquiring first reference red light compensation values corresponding to at least two first reference red sub-pixels in a same row or same column with the red sub-pixel to be compensated according to the location information of the red sub-pixel to be compensated, acquiring first reference green light compensation values corresponding to at least two first reference green sub-pixels in a same row or same column with the green sub-pixel to be compensated according to the location information of the green sub-pixel to be compensated, and acquiring first reference blue light compensation values corresponding to at least two first reference blue sub-pixels in a same row or same column with the blue sub-pixel to be compensated according to the location information of the blue sub-pixel to be compensated; and performing seventh linear interpolation according to the first reference red light compensation values corresponding to the at least two first reference red sub-pixels in the same row or same column with the red sub-pixel to be compensated to acquire the first red light compensation value corresponding to the red sub-pixel to be compensated under the first reference grayscale, performing eighth linear interpolation according to the first reference green light compensation values corresponding to the at least two first reference green sub-pixels in the same row or same column with the green sub-pixel to be compensated to acquire the first green light compensation value corresponding to the green sub-pixel to be compensated under the first reference grayscale, and performing ninth linear interpolation according to the first reference blue light compensation values corresponding to the at least two first reference blue sub-pixels in the same row or same column with the blue sub-pixel to be compensated to acquire the first blue light compensation value corresponding to the blue sub-pixel to be compensated under the first reference grayscale.

The present disclosure further provides a compensation device of a display panel, which includes a first acquisition module, a second acquisition module, a calculation module, and a compensation module;

wherein the first acquisition module is configured to acquire an original image parameter of a panel to be compensated under a target grayscale and determine location information of a pixel to be compensated of the panel to be compensated according to the original image parameter;

the second acquisition module is configured to acquire a first image parameter under a first reference grayscale and a second image parameter under a second reference grayscale of the panel to be compensated;

the calculation module is configured to determine a target compensation value of the pixel to be compensated under the target grayscale according to the location information of the pixel to be compensated, the first image parameter, and the second image parameter; and the compensation module is configured to determine compensation brightness of the pixel to be compensated under the target grayscale according to the target compensation value.

In the compensation device of the display panel provided by the present disclosure, the first acquisition module includes a first original parameter acquisition unit, and the first original parameter acquisition unit is configured to acquire first location information of any one of pixels when the panel to be compensated displays white light under the target grayscale and determine the location information of the pixel to be compensated of the panel to be compensated according to the first location information.

In the compensation device of the display panel provided by the present disclosure, the second acquisition module includes a first image parameter acquisition unit and a second image parameter acquisition unit;

the first image parameter acquisition unit includes a first white light image parameter acquisition subunit, and the first white light image parameter acquisition subunit is configured to acquire a first reference white light compensation value of at least one first reference pixel when the panel to be compensated displays the white light under the first reference grayscale; and the second image parameter acquisition unit includes a second white light image parameter acquisition subunit, and the second white light image parameter acquisition subunit is configured to acquire a second reference white light compensation value of at least one second reference pixel when the panel to be compensated displays the white light under the second reference grayscale.

In the compensation device of the display panel provided by the present disclosure, the calculation module includes a first white light calculation unit, a second white light calculation unit, and a third white light calculation unit;

the first white light calculation unit is configured to acquire a first white light compensation value corresponding to the pixel to be compensated under the first reference grayscale according to the first location information of the pixel to be compensated and the first reference white light compensation value;

the second white light calculation unit is configured to acquire a second white light compensation value corresponding to the pixel to be compensated under the second reference grayscale according to the first location information of the pixel to be compensated and the second reference white light compensation value; and the third white light calculation unit is configured to perform first linear interpolation according to the first white light compensation value and the second white light compensation value to acquire a target white light compensation value of the pixel to be compensated under the target grayscale;

wherein a formula of the first linear interpolation is:

$$y = \frac{y2*(x1-x)}{x1-x2} + \frac{y1*(x-x2)}{x1-x2};$$

wherein x1 and x2 denote the first reference grayscale and the second reference grayscale, y1 and y2 denote the first white light compensation value and the second white light compensation value, x denotes the target grayscale, and y denotes the target white light compensation value.

In the compensation device of the display panel provided by the present disclosure, the first white light calculation unit includes a first reference white light compensation value acquisition subunit and a first white light compensation value calculation subunit;

the first reference white light compensation value acquisition subunit is configured to acquire first reference white light compensation values corresponding to at least two first reference pixels in a same row or same column with the pixel to be compensated according to the location information of the pixel to be compensated; and the first white light compensation value calculation subunit is configured to perform second linear interpolation according to the first reference white light compensation values corresponding to the at least two first reference pixels in the same row or same column with the pixel to be compensated to acquire the first white light compensation value corresponding to the pixel to be compensated under the first reference grayscale;

wherein a formula of the second linear interpolation is:

$$b = \frac{b2*(a1-a)}{a1-a2} + \frac{b1*(a-a2)}{a1-a2};$$

wherein a1 and a2 denote row count values or column count values of two first reference pixels in a same row or same column with the pixel to be compensated, b1 and b2 denote the first reference white light compensation values of the two first reference pixels in the same row or same column with the pixel to be compensated, a denotes a row count value or a column count value of the pixel to be compensated, and b denotes the first white light compensation value.

In the compensation device of the display panel provided by the present disclosure, the second white light calculation unit includes a second reference white light compensation value acquisition subunit and a second white light compensation value calculation subunit;

the second reference white light compensation value acquisition subunit is configured to acquire second reference white light compensation values corresponding to at least two second reference pixels in a same row or same column with the pixel to be compensated according to the location information of the pixel to be compensated; and the second white light compensation value calculation subunit is configured to perform third linear interpolation according to the second reference white light compensation values corresponding to the at least two second reference pixels in the same row or same column with the pixel to be compensated to acquire the second white light compensation value corresponding to the pixel to be compensated under the second reference grayscale;

wherein a formula of the third linear interpolation is:

$$n = \frac{n2*(m1-m)}{m1-m2} + \frac{n1*(m-m2)}{m1-m2};$$

wherein m1 and m2 denote row count values or column count values of two second reference pixels in a same row or same column with the pixel to be compensated, n1 and n2 denote the second reference white light compensation values of the two second reference pixels in the same row or same column with the pixel to be compensated, m denotes a row count value or a column count value of the pixel to be compensated, and n denotes the second white light compensation value.

In the compensation device of the display panel provided by the present disclosure, the first acquisition module includes a second original parameter acquisition unit, a third original parameter acquisition unit, and a fourth original parameter acquisition unit; the second original parameter acquisition unit is configured to acquire second location information of any one of red sub-pixels when the panel to be compensated displays red light under the target grayscale and determine location information of a red sub-pixel to be compensated of the panel to be compensated according to the second location information; the third original parameter acquisition unit is configured to acquire third location information of any one of green sub-pixels when the panel to be compensated displays green light under the target grayscale and determine location information of a green sub-pixel to be compensated of the panel to be compensated according to the third location information; and the fourth original parameter acquisition unit is configured to acquire fourth location information of any one of blue sub-pixels when the panel to be compensated displays blue light under the target grayscale and determine location information of a blue sub-pixel to be compensated of the panel to be compensated according to the fourth location information.

In the compensation device of the display panel provided by the present disclosure, a first image parameter acquisition unit of the second acquisition module includes a first red light image parameter acquisition subunit, a first green light image parameter acquisition subunit, and a first blue light image parameter acquisition subunit, and a second image parameter acquisition unit of the second acquisition module includes a second red light image parameter acquisition subunit, a second green light image parameter acquisition subunit, and a second blue light image parameter acquisition subunit;

the first red light image parameter acquisition subunit is configured to acquire a first reference red light compensation value of at least one of the red sub-pixels when the panel to be compensated displays the red light under the first reference grayscale; the first green light image parameter acquisition subunit is configured to acquire a first reference green light compensation value of at least one of the green sub-pixels when the panel to be compensated displays the green light under the first reference grayscale; the first blue light image parameter acquisition subunit is configured to acquire first reference blue light compensation values of at least two of the blue sub-pixels when the panel to be compensated displays the blue light under the first reference grayscale;

the second red light image parameter acquisition subunit is configured to acquire a second reference red light compensation value of at least one of the red sub-pixels when the panel to be compensated displays the red light under the second reference grayscale; the second green light image parameter acquisition subunit is configured to acquire a second reference green light compensation value of at least one of the green sub-pixels when the panel to be compensated displays the green light under the second reference grayscale; and the second green light image parameter acquisition subunit is configured to acquire a second reference blue light compensation value of at least one of the blue sub-pixels when the panel to be compensated displays the blue light under the second reference grayscale.

In the compensation device of the display panel provided by the present disclosure, the calculation module includes a first red light calculation unit, a second red light calculation unit, a third red light calculation unit, a first green light calculation unit, a second green light calculation unit, a third green light calculation unit, a first blue light calculation unit, a second blue light calculation unit, and a third blue light calculation unit;

the first red light calculation unit is configured to acquire a first red light compensation value corresponding to the red sub-pixel to be compensated under the first reference grayscale according to the location information of the red sub-pixel to be compensated and the first reference red light compensation value; the first green light calculation unit is configured to acquire a first green light compensation value corresponding to the green sub-pixel to be compensated under the first reference grayscale according to the location information of the green sub-pixel to be compensated and the first reference green light compensation value; the first blue light calculation unit is configured to acquire a first blue light compensation value corresponding to the blue sub-pixel to be compensated under the first reference grayscale according to the location information of the blue sub-pixel to be compensated and the first reference blue light compensation value;

the second red light calculation unit is configured to acquire a second red light compensation value corresponding to the red sub-pixel to be compensated under the second reference grayscale according to the location information of the red sub-pixel to be compensated and the second reference red light compensation value; the second green light calculation unit is configured to acquire a second green light compensation value corresponding to the green sub-pixel to be compensated under the second reference grayscale according to the location information of the green sub-pixel to be compensated and the second reference green light compensation value; the second blue light calculation unit is configured to acquire a second blue light compensation value corresponding to the blue sub-pixel to be compensated under the second reference grayscale according to the location information of the blue sub-pixel to be compensated and the second reference blue light compensation value;

the third red light calculation unit is configured to perform fourth linear interpolation according to the first red light compensation value and the second red light compensation value to acquire a target red light compensation value of the red sub-pixel to be compensated under the target grayscale; the third green light calculation unit is configured to perform fifth linear interpolation according to the first green light compensation value and the second green light compensation value to acquire a target green light compensation value of the green sub-pixel to be compensated under the target grayscale; and the third blue light calculation unit is configured to perform sixth linear interpolation according to the first blue light compensation value and the second blue light compensation value to acquire a target blue light compensation value of the blue sub-pixel to be compensated under the target grayscale.

In the compensation device of the display panel provided by the present disclosure, the first red light calculation unit includes a first reference red light compensation value acquisition subunit and a first red light compensation value calculation subunit, the first green light calculation unit includes a first reference green light compensation value acquisition subunit and a first green light compensation value calculation subunit, and the first blue light calculation unit includes a first reference blue light compensation value acquisition subunit and a first blue light compensation value calculation subunit;

the first reference red light compensation value acquisition subunit is configured to acquire first reference red light compensation values corresponding to at least two first reference red sub-pixels in a same row or same column with the red sub-pixel to be compensated according to the location information of the red sub-pixel to be compensated; the first reference green light compensation value acquisition subunit is configured to acquire first reference green light compensation values corresponding to at least two first reference green sub-pixels in a same row or same column with the green sub-pixel to be compensated according to the location information of the green sub-pixel to be compensated; the first reference blue light compensation value acquisition subunit is configured to acquire first reference blue light compensation values corresponding to at least two first reference blue sub-pixels in a same row or same column with the blue sub-pixel to be compensated according to the location information of the blue sub-pixel to be compensated;

the first red light compensation value calculation subunit is configured to perform seventh linear interpolation according to the first reference red light compensation values corresponding to the at least two first reference red sub-pixels in the same row or same column with the red sub-pixel to be compensated to acquire the first red light compensation value corresponding to the red sub-pixel to be compensated under the first reference grayscale; the first green light compensation value calculation subunit is configured to perform eighth linear interpolation according to the first reference green light compensation values corresponding to the at least two first reference green sub-pixels in the same row or same column with the green sub-pixel to be compensated to acquire the first green light compensation value corresponding to the green sub-pixel to be compensated under the first reference grayscale; and the first blue light compensation value calculation subunit is configured to perform ninth linear interpolation according to the first reference blue light compensation values corresponding to the at least two first reference blue sub-pixels in the same row or same column with the blue sub-pixel to be compensated to acquire the first blue light compensation value corresponding to the blue sub-pixel to be compensated under the first reference grayscale.

Beneficial effect: the present disclosure acquires the target compensation value of the pixel to be compensated under the target grayscale by acquiring the location information, the first image parameter, and the second image parameter of the pixel to be compensated, and then compensates the pixel to be compensated according to the target compensation value, thereby uniforming display brightness of a display panel to be compensated and improving display quality of the display panel to be compensated.

BRIEF DESCRIPTION OF THE SEVERAL VIEWS OF THE DRAWINGS

The following detailed description of specific embodiments of the present disclosure will make the technical solutions and other beneficial effects of the present disclosure obvious with reference to the accompanying drawings.

DETAILED DESCRIPTION OF PREFERRED SPECIFIC EMBODIMENTS OF THE INVENTION

The present disclosure provides a compensation method of a display panel and a compensation device thereof. In order to make the purpose, technical solutions, and effects of this disclosure clearer and more definite, the following further describes this disclosure in detail with reference to the drawings and embodiments. It should be understood that the specific embodiments described herein are only used to explain the disclosure, and are not used to limit the disclosure.

Due to spliced backlight sources, current liquid crystal display panels using mini-light-emitting diodes have non-uniform display brightness at splicing locations in the display panels, and cause display quality of the display panels to be affected. Based on this, the present disclosure provides the compensation method of the display panel and the compensation device thereof.

Figure 1:
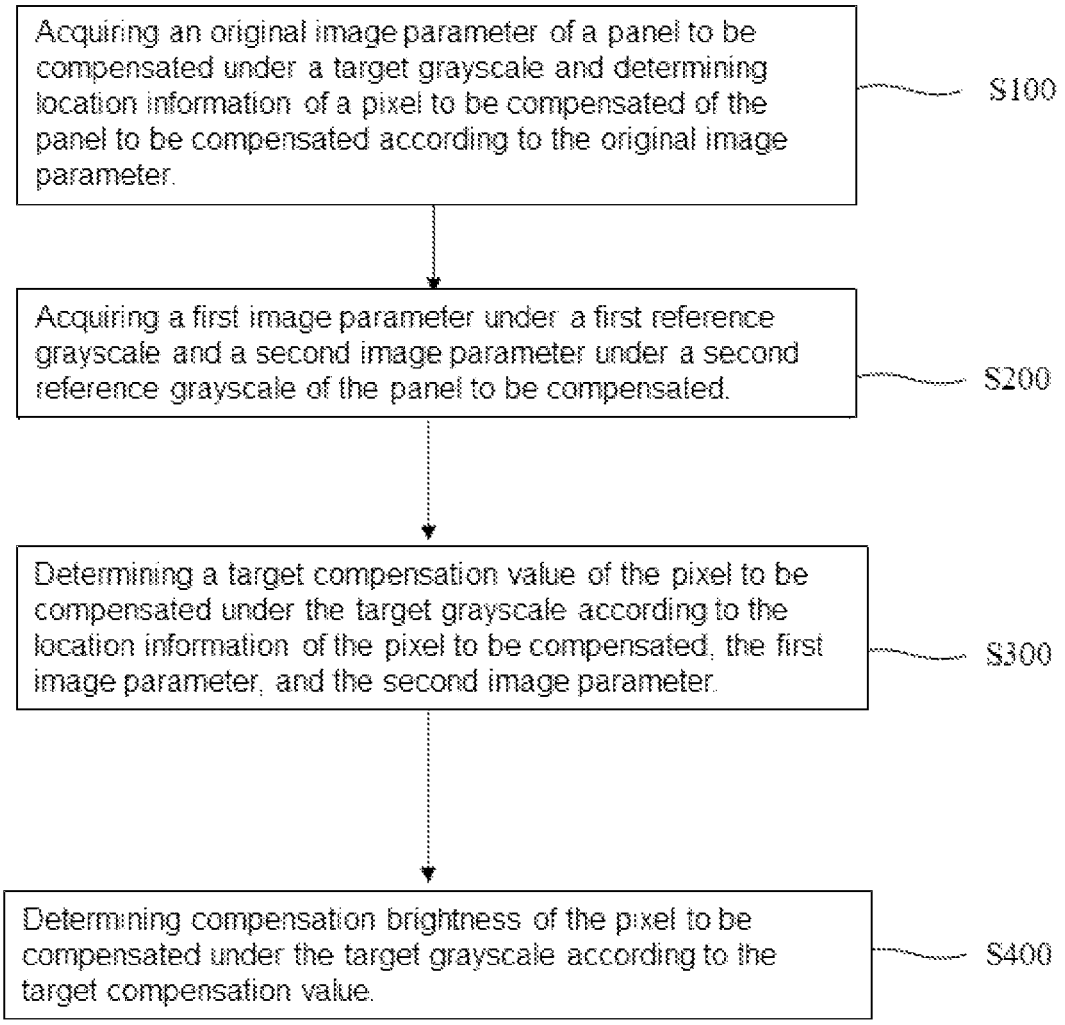
FIG. 1 is a schematic diagram of a compensation method of a display panel according to an embodiment of the present disclosure.
Figure 2:
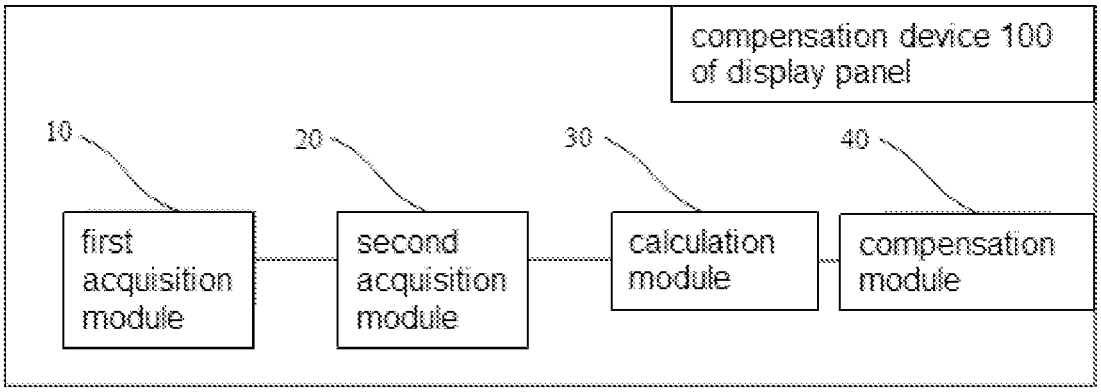
FIG. 2 is a first schematic structural diagram of a compensation device of the display panel according to an embodiment of the present disclosure.
Figure 3:
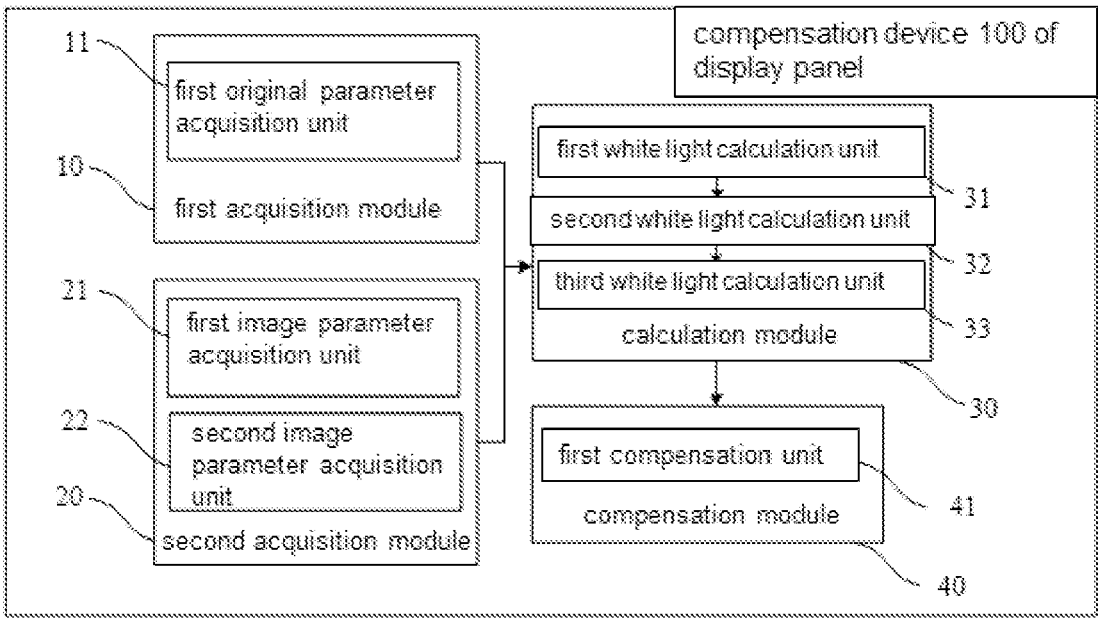
FIG. 3 is a second schematic structural diagram of the compensation device of the display panel according to an embodiment of the present disclosure.
Figure 4:
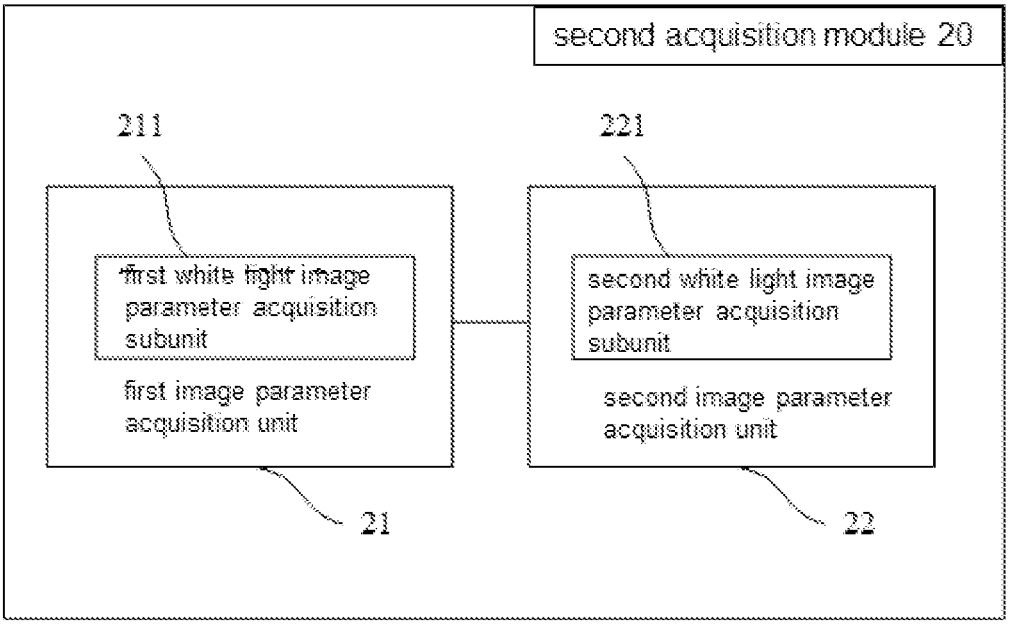
FIG. 4 is a schematic structural diagram of a second acquisition module of the compensation device of the display panel according to an embodiment of the present disclosure.
Figure 5:
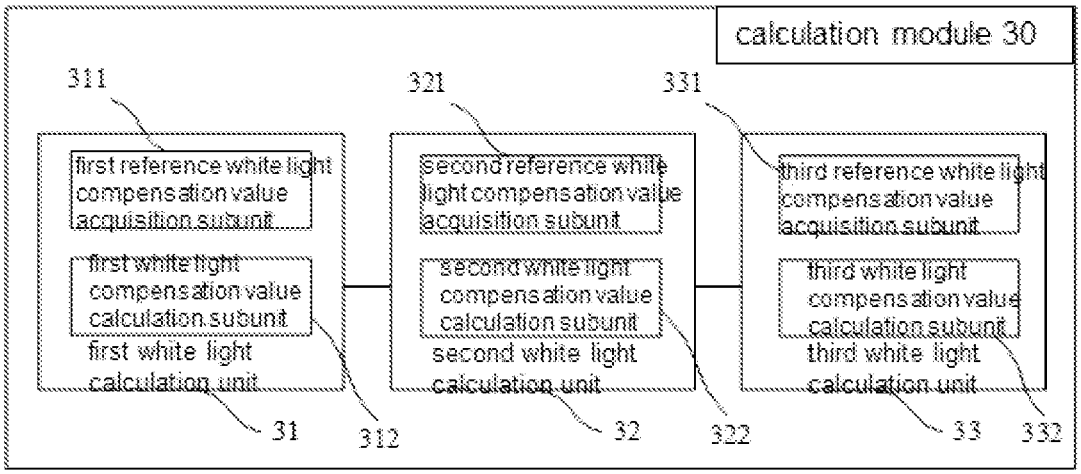
FIG. 5 is a schematic structural diagram of a calculation module of the compensation device of the display panel according to an embodiment of the present disclosure.

Referring to FIG. 1, the compensation method of the display panel includes following steps.

Step S100: acquiring an original image parameter of a panel to be compensated under a target grayscale and determining location information of a pixel to be compensated of the panel to be compensated according to the original image parameter.

In this embodiment, the step S100 may include a following step.

Step S111: acquiring first location information of any one of pixels when the panel to be compensated displays white light under the target grayscale and determining the location information of the pixel to be compensated of the panel to be compensated according to the first location information.

In this embodiment, the first location information may include a first row count value and/or a first column count value of any one of the pixels in the panel to be compensated. For example, a first row count value 100 and a first column count value 200 denote a pixel in a location of a 100th row from top to bottom and a 200th column from left to right of the panel to be compensated.

In this embodiment, the step S111 may include following steps.

Step S111*a*: acquiring a first row count value and/or a first column count value of a target pixel.

Step S111*b*: determining if the target pixel is the pixel to be compensated according to the first row count value and/or the first column count value of the target pixel. If yes, then the target pixel is the pixel to be compensated, and if no, then determining if a next target pixel is the pixel to be compensated according to a first row count value and/or a first column count value of the next target pixel until determining the target pixel being the pixel to be compensated or finishing counting all of rows and/or columns in the panel to be compensated.

Step S111*c*: acquiring a first row count value and/or a first column count value of the pixel to be compensated as first location information of the pixel to be compensated.

In this embodiment, the step S100 may also include following steps.

Step S121: acquiring second location information of any one of red sub-pixels when the panel to be compensated displays red light under the target grayscale and determining location information of a red sub-pixel to be compensated of the panel to be compensated according to the second location information.

Step S122: acquiring third location information of any one of green sub-pixels when the panel to be compensated displays green light under the target grayscale and determining location information of a green sub-pixel to be compensated of the panel to be compensated according to the third location information.

Step S123: acquiring fourth location information of any one of blue sub-pixels when the panel to be compensated displays blue light under the target grayscale and determining location information of a blue sub-pixel to be compensated of the panel to be compensated according to the fourth location information.

In this embodiment, the second location information may include a second row count value and/or a second column count value of any one of the red sub-pixels in the panel to be compensated. For example, a second row count value 100 and a second column count value 200 denote a red sub-pixel in a location of a 100th row from top to bottom and a 200th column from left to right of the panel to be compensated.

Similarly, the third location information may include a third row count value and/or a third column count value of any one of the green sub-pixels in the panel to be compensated. The fourth location information may include a fourth row count value and/or a fourth column count value of any one of the blue sub-pixels in the panel to be compensated.

Step S200: acquiring a first image parameter under a first reference grayscale and a second image parameter under a second reference grayscale of the panel to be compensated.

In this embodiment, the step S200 may include following steps.

Step S211: acquiring a first reference white light compensation value of at least one first reference pixel when the panel to be compensated displays the white light under the first reference grayscale.

In this embodiment, it may be acquiring a first reference white light compensation value of any one of the pixels when the panel to be compensated displays the white light under the first reference grayscale, or may be acquiring first reference white light compensation values corresponding to first reference pixels which are at least two of the pixels having known first reference white light compensation values when the panel to be compensated displays the white light under the first reference grayscale.

Step S212: acquiring a second reference white light compensation value of at least one second reference pixel when the panel to be compensated displays the white light under the second reference grayscale.

In this embodiment, it may be acquiring a second reference white light compensation value of any one of the pixels when the panel to be compensated displays the white light under the second reference grayscale, or may be acquiring second reference white light compensation values corresponding to second reference pixels which are at least two of the pixels having known second reference white light compensation values when the panel to be compensated displays the white light under the second reference grayscale.

In this embodiment, the step S200 may also include following steps.

Step S221: acquiring a first reference red light compensation value of at least one of the red sub-pixels when the panel to be compensated displays the red light under the first reference grayscale, acquiring a first reference green light compensation value of at least one of the green sub-pixels when the panel to be compensated displays the green light under the first reference grayscale, and acquiring first reference blue light compensation values of at least two of the blue sub-pixels when the panel to be compensated displays the blue light under the first reference grayscale.

In this embodiment, it may be acquiring a first reference red light compensation value of any one of the red sub-pixels when the panel to be compensated displays the red light under the first reference grayscale, or may be acquiring first reference red light compensation values corresponding to first reference red sub-pixels which are at least two of the red sub-pixels having known first reference red light compensation values when the panel to be compensated displays the red light under the first reference grayscale. Similarly, it may be acquiring a first reference green light compensation value of any one of the green sub-pixels when the panel to be compensated displays the green light under the first reference grayscale, or may be acquiring first reference green light compensation values corresponding to first reference green sub-pixels which are at least two of the green sub-pixels having known first reference green light compensation values when the panel to be compensated displays the green light under the first reference grayscale. Similarly, it may be acquiring a first reference blue light compensation value of any one of the blue sub-pixels when the panel to be compensated displays the blue light under the first reference grayscale, or may be acquiring first reference blue light compensation values corresponding to first reference blue sub-pixels which are at least two of the blue sub-pixels having known first reference blue light compensation values when the panel to be compensated displays the blue light under the first reference grayscale.

Step S222: acquiring a second reference red light compensation value of at least one of the red sub-pixels when the panel to be compensated displays the red light under the second reference grayscale, acquiring a second reference green light compensation value of at least one of the green sub-pixels when the panel to be compensated displays the green light under the second reference grayscale, and acquiring a second reference blue light compensation value of at least one of the blue sub-pixels when the panel to be compensated displays the blue light under the second reference grayscale.

Selection of the second reference red light compensation value, the second reference green light compensation value, and the second reference blue light compensation value in the step S222 is similar to that in the step S221, and is not repeated here.

Step S300: determining a target compensation value of the pixel to be compensated under the target grayscale according to the location information of the pixel to be compensated, the first image parameter, and the second image parameter.

In this embodiment, the step S300 may include following steps.

Step S311: acquiring a first white light compensation value corresponding to the pixel to be compensated under the first reference grayscale according to the location information of the pixel to be compensated and the first reference white light compensation value.

In this embodiment, when it is the first reference white light compensation value of any one of the pixels being acquired when the panel to be compensated displays the white light under the first reference grayscale in the step S211, the first white light compensation value corresponding to the pixel to be compensated under the first reference grayscale can be directly acquired according to the location information of the pixel to be compensated.

In this embodiment, when they are the first reference white light compensation values corresponding to the first reference pixels which are at least two of the pixels having known first reference white light compensation values being acquired when the panel to be compensated displays the white light under the first reference grayscale in the step S211, the step S311 may include following steps.

Step S311*a*: acquiring the first reference white light compensation values corresponding to at least two first reference pixels in a same row or same column with the pixel to be compensated according to the location information of the pixel to be compensated.

For example, if the first location information of the pixel to be compensated is 233rd row and 100th column, first location information of the first reference pixels may be 233rd row and 55th column and 233rd row and 150th column, or the first location information of the first reference pixels may be 122nd row and 100th column and 311st row and 100th column.

Step S311*b*: performing second linear interpolation according to the first reference white light compensation values corresponding to the at least two first reference pixels in the same row or same column with the pixel to be compensated to acquire the first white light compensation value corresponding to the pixel to be compensated under the first reference grayscale.

A formula of the second linear interpolation is:

$$b = \frac{b2 * (a1 - a)}{a1 - a2} + \frac{b1 * (a - a2)}{a1 - a2};$$

wherein, a1 and a2 denote row count values or column count values of two first reference pixels in a same row or same column with the pixel to be compensated, b1 and b2 denote the first reference white light compensation values of the two first reference pixels in the same row or same column with the pixel to be compensated, a denotes a row count value or a column count value of the pixel to be compensated, and b denotes the first white light compensation value.

Step S312: acquiring a second white light compensation value corresponding to the pixel to be compensated under the second reference grayscale according to the location information of the pixel to be compensated and the second reference white light compensation value.

In this embodiment, when it is the second reference white light compensation value of any one of the pixels being acquired when the panel to be compensated displays the white light under the second reference grayscale in the step S212, the second white light compensation value corresponding to the pixel to be compensated under the second reference grayscale can be directly acquired according to the location information of the pixel to be compensated.

In this embodiment, when they are the second reference white light compensation values corresponding to the second reference pixels which are at least two of the pixels having known second reference white light compensation values being acquired when the panel to be compensated displays the white light under the second reference grayscale in the step S212, the step S312 may include following steps.

Step S312*a*: acquiring the second reference white light compensation values corresponding to at least two second reference pixels in a same row or same column with the pixel to be compensated according to the location information of the pixel to be compensated.

Step S312*b*: performing third linear interpolation according to the second reference white light compensation values corresponding to the at least two second reference pixels in the same row or same column with the pixel to be compensated to acquire the second white light compensation value corresponding to the pixel to be compensated under the second reference grayscale.

A formula of the third linear interpolation is:

$$n = \frac{n2 * (m1 - m)}{m1 - m2} + \frac{n1 * (m - m2)}{m1 - m2};$$

wherein, m1 and m2 denote row count values or column count values of two second reference pixels in a same row or same column with the pixel to be compensated, n1 and n2 denote the second reference white light compensation values of the two second reference pixels in the same row or same column with the pixel to be compensated, m denotes a row count value or a column count value of the pixel to be compensated, and n denotes the second white light compensation value.

Step S313: performing first linear interpolation according to the first white light compensation value and the second white light compensation value to acquire a target white light compensation value of the pixel to be compensated under the target grayscale.

A formula of the first linear interpolation is:

$$y = \frac{y2 * (x1 - x)}{x1 - x2} + \frac{y1 * (x - x2)}{x1 - x2};$$

wherein, x1 and x2 denote the first reference grayscale and the second reference grayscale, y1 and y2 denote the first white light compensation value and the second white light compensation value, x denotes the target grayscale, and y denotes the target white light compensation value.

In this embodiment, the step S300 may also include following steps.

Step S321: acquiring a first red light compensation value corresponding to the red sub-pixel to be compensated under the first reference grayscale according to the location information of the red sub-pixel to be compensated and the first reference red light compensation value, acquiring a first green light compensation value corresponding to the green sub-pixel to be compensated under the first reference grayscale according to the location information of the green sub-pixel to be compensated and the first reference green light compensation value, and acquiring a first blue light compensation value corresponding to the blue sub-pixel to be compensated under the first reference grayscale according to the location information of the blue sub-pixel to be compensated and the first reference blue light compensation value.

In this embodiment, when it is the first reference red light compensation value of any one of the red sub-pixels being acquired when the panel to be compensated displays the red light under the first reference grayscale, the first reference green light compensation value of any one of the green sub-pixels being acquired when the panel to be compensated displays the green light under the first reference grayscale, and the first reference blue light compensation value of any one of the blue sub-pixels being acquired when the panel to be compensated displays the blue light under the first reference grayscale in the step S221, the first red light compensation value corresponding to the red sub-pixel to be compensated under the first reference grayscale can be directly acquired according to the location information of the red sub-pixel to be compensated, the first green light compensation value corresponding to the green sub-pixel to be compensated under the first reference grayscale can be directly acquired according to the location information of the green sub-pixel to be compensated, and the first blue light compensation value corresponding to the blue sub-pixel to be compensated under the first reference grayscale can be directly acquired according to the location information of the blue sub-pixel to be compensated.

In this embodiment, when they are the first reference red light compensation values corresponding to a plurality of first reference red sub-pixels, the first reference green light compensation values corresponding to a plurality of first reference green sub-pixels, and the first reference blue light compensation values corresponding to a plurality of first reference blue sub-pixels being acquired in the step S221, the step S321 may include following steps.

Step S321*a*: acquiring the first reference red light compensation values corresponding to at least two first reference red sub-pixels in a same row or same column with the red sub-pixel to be compensated according to the location information of the red sub-pixel to be compensated, acquiring the first reference green light compensation values corresponding to at least two first reference green sub-pixels in a same row or same column with the green sub-pixel to be compensated according to the location information of the green sub-pixel to be compensated, and acquiring the first reference blue light compensation values corresponding to at least two first reference blue sub-pixels in a same row or same column with the blue sub-pixel to be compensated according to the location information of the blue sub-pixel to be compensated.

Step S321*b*: performing seventh linear interpolation according to the first reference red light compensation values corresponding to the at least two first reference red sub-pixels in the same row or same column with the red sub-pixel to be compensated to acquire the first red light compensation value corresponding to the red sub-pixel to be compensated under the first reference grayscale, performing eighth linear interpolation according to the first reference green light compensation values corresponding to the at least two first reference green sub-pixels in the same row or same column with the green sub-pixel to be compensated to acquire the first green light compensation value corresponding to the green sub-pixel to be compensated under the first reference grayscale, and performing ninth linear interpolation according to the first reference blue light compensation values corresponding to the at least two first reference blue sub-pixels in the same row or same column with the blue sub-pixel to be compensated to acquire the first blue light compensation value corresponding to the blue sub-pixel to be compensated under the first reference grayscale.

A formula of the seventh linear interpolation, the eighth linear interpolation, and the ninth linear interpolation is:

$$d = \frac{d2*(c1-c)}{c1-c2} + \frac{d1*(c-c2)}{c1-c2};$$

wherein, c1 and c2 denote row count values or column count values of two first reference red sub-pixels in a same row or same column with the red sub-pixel to be compensated, row count values or column count values of two first reference green sub-pixels in a same row or same column with the green sub-pixel to be compensated, or row count values or column count values of two first reference blue sub-pixels in a same row or same column with the blue sub-pixel to be compensated; d1 and d2 denote the first reference red light compensation values of the two first reference red sub-pixels in the same row or same column with the red sub-pixel to be compensated, the first reference green light compensation values of the two first reference green sub-pixels in the same row or same column with the green sub-pixel to be compensated, or the first reference blue light compensation values of the two first reference blue sub-pixels in the same row or same column with the blue sub-pixel to be compensated; c denotes a row count value or a column count value of the red sub-pixel to be compensated, the green sub-pixel to be compensated, or the blue sub-pixel to be compensated; and d denotes the first red light compensation value of the red sub-pixel to be compensated under the first reference grayscale, the first green light compensation value of the green sub-pixel to be compensated under the first reference grayscale, or the first blue light compensation value of the blue sub-pixel to be compensated under the first reference grayscale.

Step S322: acquiring a second red light compensation value corresponding to the red sub-pixel to be compensated under the second reference grayscale according to the location information of the red sub-pixel to be compensated and the second reference red light compensation value, acquiring a second green light compensation value corresponding to the green sub-pixel to be compensated under the second reference grayscale according to the location information of the green sub-pixel to be compensated and the second reference green light compensation value, and acquiring a second blue light compensation value corresponding to the blue sub-pixel to be compensated under the second reference grayscale according to the location information of the blue sub-pixel to be compensated and the second reference blue light compensation value.

In this embodiment, when it is the second reference red light compensation value of any one of the red sub-pixels being acquired when the panel to be compensated displays the red light under the second reference grayscale, the second reference green light compensation value of any one of the green sub-pixels being acquired when the panel to be compensated displays the green light under the second reference grayscale, and the second reference blue light compensation value of any one of the blue sub-pixels being acquired when the panel to be compensated displays the blue light under the second reference grayscale in the step S222, the second red light compensation value corresponding to the red sub-pixel to be compensated under the second reference grayscale can be directly acquired according to the location information of the red sub-pixel to be compensated, the second green light compensation value corresponding to the green sub-pixel to be compensated under the second reference grayscale can be directly acquired according to the location information of the green sub-pixel to be compensated, and the second blue light compensation value corresponding to the blue sub-pixel to be compensated under the second reference grayscale can be directly acquired according to the location information of the blue sub-pixel to be compensated.

In this embodiment, when they are the second reference red light compensation values corresponding to a plurality of second reference red sub-pixels, the second reference green light compensation values corresponding to a plurality of second reference green sub-pixels, and the second reference blue light compensation values corresponding to a plurality of second reference blue sub-pixels being acquired in the step S222, the step S322 may include following steps.

Step S322*a*: acquiring the second reference red light compensation values corresponding to at least two second reference red sub-pixels in a same row or same column with the red sub-pixel to be compensated according to the location information of the red sub-pixel to be compensated, acquiring the second reference green light compensation values corresponding to at least two second reference green sub-pixels in a same row or same column with the green sub-pixel to be compensated according to the location information of the green sub-pixel to be compensated, and acquiring the second reference blue light compensation values corresponding to at least two second reference blue sub-pixels in a same row or same column with the blue sub-pixel to be compensated according to the location information of the blue sub-pixel to be compensated.

Step S322*b*: performing tenth linear interpolation according to the second reference red light compensation values corresponding to the at least two second reference red sub-pixels in the same row or same column with the red sub-pixel to be compensated to acquire the second red light compensation value corresponding to the red sub-pixel to be compensated under the second reference grayscale, performing eleventh linear interpolation according to the second reference green light compensation values corresponding to the at least two second reference green sub-pixels in the same row or same column with the green sub-pixel to be compensated to acquire the second green light compensation value corresponding to the green sub-pixel to be compensated under the second reference grayscale, and performing twelfth linear interpolation according to the second reference blue light compensation values corresponding to the at least two second reference blue sub-pixels in the same row or same column with the blue sub-pixel to be compensated to acquire the second blue light compensation value corresponding to the blue sub-pixel to be compensated under the second reference grayscale.

A general formula of the tenth linear interpolation, the eleventh linear interpolation, and the twelfth linear interpolation is:

$$f = \frac{f2*(e1-e)}{e1-e2} + \frac{f1*(e-e2)}{e1-e2};$$

wherein, e1 and e2 denote row count values or column count values of two second reference red sub-pixels in a same row or same column with the red sub-pixel to be compensated, row count values or column count values of two second reference green sub-pixels in a same row or same column with the green sub-pixel to be compensated, or row count values or column count values of two second reference blue sub-pixels in a same row or same column with the blue sub-pixel to be compensated; f1 and f2 denote the second reference red light compensation values of the two second reference red sub-pixels in the same row or same column with the red sub-pixel to be compensated, the second reference green light compensation values of the two second reference green sub-pixels in the same row or same column with the green sub-pixel to be compensated, or the second reference blue light compensation values of the two second reference blue sub-pixels in the same row or same column with the blue sub-pixel to be compensated; e denotes a row count value or a column count value of the red sub-pixel to be compensated, the green sub-pixel to be compensated, or the blue sub-pixel to be compensated; and f denotes the second red light compensation value, the second green light compensation value, or the second blue light compensation value.

Step S323: performing fourth linear interpolation according to the first red light compensation value and the second red light compensation value to acquire a target red light compensation value of the red sub-pixel to be compensated under the target grayscale, performing fifth linear interpolation according to the first green light compensation value and the second green light compensation value to acquire a target green light compensation value of the green sub-pixel to be compensated under the target grayscale, and performing sixth linear interpolation according to the first blue light compensation value and the second blue light compensation value to acquire a target blue light compensation value of the blue sub-pixel to be compensated under the target grayscale.

In this embodiment, a general formula of the fourth linear interpolation, the fifth linear interpolation, and the sixth linear interpolation may be:

$$h = \frac{h2*(g1-g)}{g1-g2} + \frac{h1*(g-g2)}{g1-g2};$$

wherein, g1 and g2 denote the first reference grayscale and the second reference grayscale; h1 and h2 denote the first red light compensation value and the second red light compensation value, the first green light compensation value and the second green light compensation value, or the first blue light compensation value and the second blue light compensation value; g denotes the target grayscale; and h denotes the target red light compensation value, the target green light compensation value, or the target blue light compensation value.

Step S400: determining compensation brightness of the pixel to be compensated under the target grayscale according to the target compensation value.

In this embodiment, the step S400 may include a following step.

Step S410: determining white light compensation brightness of the pixel to be compensated under the target grayscale according to the target white light compensation value of the pixel to be compensated under the target grayscale.

In this embodiment, the step S400 may also include following a following step.

Step S420: determining red light compensation brightness of the red sub-pixel to be compensated under the target grayscale, green light compensation brightness of the green sub-pixel to be compensated under the target grayscale, and blue light compensation brightness of the blue sub-pixel to be compensated under the target grayscale according to the target red light compensation value of the red sub-pixel to be compensated under the target grayscale, the target green light compensation value of the green sub-pixel to be compensated under the target grayscale, and the target blue light compensation value of the blue sub-pixel to be compensated under the target grayscale.

The present disclosure acquires the target compensation value of the pixel to be compensated under the target grayscale by acquiring the location information, the first image parameter, and the second image parameter of the pixel to be compensated, and then compensates the pixel to be compensated according to the target compensation value, thereby uniforming display brightness of the display panel to be compensated and improving display quality of the display panel to be compensated.

Referring to FIGS. 2 to 5, the present disclosure further provides the compensation device 100 of the display panel, which includes a first acquisition module 10, a second acquisition module 20, a calculation module 30, and a compensation module 40.

The first acquisition module 10 is configured to acquire the original image parameter of the panel to be compensated under the target grayscale and determine the location information of the pixel to be compensated of the panel to be compensated according to the original image parameter.

The second acquisition module 20 is configured to acquire the first image parameter under the first reference grayscale and the second image parameter under the second reference grayscale of the panel to be compensated.

The calculation module 30 is configured to determine the target compensation value of the pixel to be compensated under the target grayscale according to the location information of the pixel to be compensated, the first image parameter, and the second image parameter.

The compensation module 40 is configured to determine the compensation brightness of the pixel to be compensated under the target grayscale according to the target compensation value.

In this embodiment, the first acquisition module 10 includes a first original parameter acquisition unit 11, and the first original parameter acquisition unit 11 is configured to acquire the first location information of any one of pixels when the panel to be compensated displays the white light under the target grayscale and determine the location information of the pixel to be compensated of the panel to be compensated according to the first location information.

In this embodiment, the first acquisition module 10 may also include a second original parameter acquisition unit, a third original parameter acquisition unit, and a fourth original parameter acquisition unit. The second original parameter acquisition unit is configured to acquire the second location information of any one of the red sub-pixels when the panel to be compensated displays the red light under the target grayscale and determine the location information of the red sub-pixel to be compensated of the panel to be compensated according to the second location information. The third original parameter acquisition unit is configured to acquire the third location information of any one of the green sub-pixels when the panel to be compensated displays the green light under the target grayscale and determine the location information of the green sub-pixel to be compensated of the panel to be compensated according to the third location information. The fourth original parameter acquisition unit is configured to acquire the fourth location information of any one of the blue sub-pixels when the panel to be compensated displays the blue light under the target grayscale and determine the location information of the blue sub-pixel to be compensated of the panel to be compensated according to the fourth location information.

In this embodiment, the first acquisition module 10 may include a first storage unit which is configured to store the original image parameter.

In this embodiment, the second acquisition module 20 may include a first image parameter acquisition unit 21 and a second image parameter acquisition unit 22.

The first image parameter acquisition unit 21 may include a first white light image parameter acquisition subunit 211, and the first white light image parameter acquisition subunit 211 is configured to acquire the first reference white light compensation value of at least one first reference pixel when the panel to be compensated displays the white light under the first reference grayscale.

The second image parameter acquisition unit 22 may include a second white light image parameter acquisition subunit 221, and the second white light image parameter acquisition subunit 221 is configured to acquire the second reference white light compensation value of at least one second reference pixel when the panel to be compensated displays the white light under the second reference grayscale.

In this embodiment, the first image parameter acquisition unit 21 may also include a first red light image parameter acquisition subunit, a first green light image parameter acquisition subunit, and a first blue light image parameter acquisition subunit.

The first red light image parameter acquisition subunit is configured to acquire the first reference red light compensation value of at least one of the red sub-pixels when the panel to be compensated displays the red light under the first reference grayscale. The first green light image parameter acquisition subunit is configured to acquire the first reference green light compensation value of at least one of the green sub-pixels when the panel to be compensated displays the green light under the first reference grayscale. The first blue light image parameter acquisition subunit is configured to acquire first reference blue light compensation values of at least two of the blue sub-pixels when the panel to be compensated displays the blue light under the first reference grayscale.

In this embodiment, the second image parameter acquisition unit 22 may also include a second red light image parameter acquisition subunit, a second green light image parameter acquisition subunit, and a second blue light image parameter acquisition subunit.

The second red light image parameter acquisition subunit is configured to acquire the second reference red light compensation value of at least one of the red sub-pixels when the panel to be compensated displays the red light under the second reference grayscale. The second green light image parameter acquisition subunit is configured to acquire the second reference green light compensation value of at least one of the green sub-pixels when the panel to be compensated displays the green light under the second reference grayscale. The second green light image parameter acquisition subunit is configured to acquire the second reference blue light compensation value of at least one of the blue sub-pixels when the panel to be compensated displays the blue light under the second reference grayscale.

In this embodiment, the second acquisition module 20 may also include a second storage unit which is configured to store the first image parameter and the second image parameter.

In this embodiment, the calculation module 30 may include a first white light calculation unit 31, a second white light calculation unit 32, and a third white light calculation unit 33.

The first white light calculation unit 31 is configured to acquire the first white light compensation value corresponding to the pixel to be compensated under the first reference grayscale according to the first location information of the pixel to be compensated and the first reference white light compensation value.

In this embodiment, the first white light calculation unit 31 also includes a first reference white light compensation value acquisition subunit 311 and a first white light compensation value calculation subunit 312.

The first reference white light compensation value acquisition subunit 311 is configured to acquire the first reference white light compensation values corresponding to the at least two first reference pixels in the same row or same column with the pixel to be compensated according to the location information of the pixel to be compensated.

the first white light compensation value calculation subunit 312 is configured to perform the second linear interpolation according to the first reference white light compensation values corresponding to the at least two first reference pixels in the same row or same column with the pixel to be compensated to acquire the first white light compensation value corresponding to the pixel to be compensated under the first reference grayscale.

The formula of the second linear interpolation is:

$$b = \frac{b2*(a1-a)}{a1-a2} + \frac{b1*(a-a2)}{a1-a2};$$

wherein, a1 and a2 denote the row count values or column count values of the two first reference pixels in the same row or same column with the pixel to be compensated, b1 and b2 denote the first reference white light compensation values of the two first reference pixels in the same row or same column with the pixel to be compensated, a denotes the row count value or the column count value of the pixel to be compensated, and b denotes the first white light compensation value.

The second white light calculation unit 32 is configured to acquire the second white light compensation value corresponding to the pixel to be compensated under the second reference grayscale according to the first location information of the pixel to be compensated and the second reference white light compensation value.

In this embodiment, the second white light calculation unit 32 also includes a second reference white light compensation value acquisition subunit 321 and a second white light compensation value calculation subunit 322.

The second reference white light compensation value acquisition subunit 321 is configured to acquire the second reference white light compensation values corresponding to the at least two second reference pixels in the same row or same column with the pixel to be compensated according to the location information of the pixel to be compensated.

The second white light compensation value calculation subunit 322 is configured to perform the third linear interpolation according to the second reference white light compensation values corresponding to the at least two second reference pixels in the same row or same column with the pixel to be compensated to acquire the second white light compensation value corresponding to the pixel to be compensated under the second reference grayscale.

The formula of the third linear interpolation is:

$$n = \frac{n2*(m1-m)}{m1-m2} + \frac{n1*(m-m2)}{m1-m2};$$

wherein, m1 and m2 denote the row count values or column count values of two second reference pixels in the same row or same column with the pixel to be compensated, n1 and n2 denote the second reference white light compensation values of the two second reference pixels in the same row or same column with the pixel to be compensated, m denotes the row count value or the column count value of the pixel to be compensated, and n denotes the second white light compensation value.

The third white light calculation unit 33 is configured to perform the first linear interpolation according to the first white light compensation value and the second white light compensation value to acquire the target white light compensation value of the pixel to be compensated under the target grayscale.

The formula of the first linear interpolation is:

$$y = \frac{y2*(x1-x)}{x1-x2} + \frac{y1*(x-x2)}{x1-x2};$$

wherein, x1 and x2 denote the first reference grayscale and the second reference grayscale, y1 and y2 denote the first white light compensation value and the second white light compensation value, x denotes the target grayscale, and y denotes the target white light compensation value.

In this embodiment, the calculation module 30 may also include a first red light calculation unit, a second red light calculation unit, a third red light calculation unit, a first green light calculation unit, a second green light calculation unit, a third green light calculation unit, a first blue light calculation unit, a second blue light calculation unit, and a third blue light calculation unit.

The first red light calculation unit is configured to acquire the first red light compensation value corresponding to the red sub-pixel to be compensated under the first reference grayscale according to the location information of the red sub-pixel to be compensated and the first reference red light compensation value. The first green light calculation unit is configured to acquire the first green light compensation value corresponding to the green sub-pixel to be compensated under the first reference grayscale according to the location information of the green sub-pixel to be compensated and the first reference green light compensation value. The first blue light calculation unit is configured to acquire the first blue light compensation value corresponding to the blue sub-pixel to be compensated under the first reference grayscale according to the location information of the blue sub-pixel to be compensated and the first reference blue light compensation value.

In this embodiment, the first red light calculation unit may include a first reference red light compensation value acquisition subunit and a first red light compensation value calculation subunit, the first green light calculation unit may include a first reference green light compensation value acquisition subunit and a first green light compensation value calculation subunit, and the first blue light calculation unit may include a first reference blue light compensation value acquisition subunit and a first blue light compensation value calculation subunit.

In this embodiment, the first reference red light compensation value acquisition subunit is configured to acquire the first reference red light compensation values corresponding to at least two first reference red sub-pixels in the same row or same column with the red sub-pixel to be compensated according to the location information of the red sub-pixel to be compensated. The first reference green light compensation value acquisition subunit is configured to acquire the first reference green light compensation values corresponding to the at least two first reference green sub-pixels in the same row or same column with the green sub-pixel to be compensated according to the location information of the green sub-pixel to be compensated. The first reference blue light compensation value acquisition subunit is configured to acquire the first reference blue light compensation values corresponding to the at least two first reference blue sub-pixels in the same row or same column with the blue sub-pixel to be compensated according to the location information of the blue sub-pixel to be compensated.

In this embodiment, the first red light compensation value calculation subunit is configured to perform the seventh linear interpolation according to the first reference red light compensation values corresponding to the at least two first reference red sub-pixels in the same row or same column with the red sub-pixel to be compensated to acquire the first red light compensation value corresponding to the red sub-pixel to be compensated under the first reference grayscale. The first green light compensation value calculation subunit is configured to perform the eighth linear interpolation according to the first reference green light compensation values corresponding to the at least two first reference green sub-pixels in the same row or same column with the green sub-pixel to be compensated to acquire the first green light compensation value corresponding to the green sub-pixel to be compensated under the first reference grayscale. The first blue light compensation value calculation subunit is configured to perform the ninth linear interpolation according to the first reference blue light compensation values corresponding to the at least two first reference blue sub-pixels in the same row or same column with the blue sub-pixel to be compensated to acquire the first blue light compensation value corresponding to the blue sub-pixel to be compensated under the first reference grayscale.

The formula of the seventh linear interpolation, the eighth linear interpolation, and the ninth linear interpolation is:

$$d = \frac{d2*(c1-c)}{c1-c2} + \frac{d1*(c-c2)}{c1-c2};$$

wherein, c1 and c2 denote the row count values or column count values of the two first reference red sub-pixels in the same row or same column with the red sub-pixel to be compensated, the row count values or column count values of the two first reference green sub-pixels in the same row or same column with the green sub-pixel to be compensated, or the row count values or column count values of the two first reference blue sub-pixels in the same row or same column with the blue sub-pixel to be compensated; d1 and d2 denote the first reference red light compensation values of the two first reference red sub-pixels in the same row or same column with the red sub-pixel to be compensated, the first reference green light compensation values of the two first reference green sub-pixels in the same row or same column with the green sub-pixel to be compensated, or the first reference blue light compensation values of the two first reference blue sub-pixels in the same row or same column with the blue sub-pixel to be compensated; c denotes the row count value or the column count value of the red sub-pixel to be compensated, the green sub-pixel to be compensated, or the blue sub-pixel to be compensated; and d denotes the first red light compensation value, the first green light compensation value, or the first blue light compensation value.

The second red light calculation unit is configured to acquire the second red light compensation value corresponding to the red sub-pixel to be compensated under the second reference grayscale according to the location information of the red sub-pixel to be compensated and the second reference red light compensation value. The second green light calculation unit is configured to acquire the second green light compensation value corresponding to the green sub-pixel to be compensated under the second reference grayscale according to the location information of the green sub-pixel to be compensated and the second reference green light compensation value. The second blue light calculation unit is configured to acquire the second blue light compensation value corresponding to the blue sub-pixel to be compensated under the second reference grayscale according to the location information of the blue sub-pixel to be compensated and the second reference blue light compensation value.

In this embodiment, the second red light calculation unit may include a second reference red light compensation value acquisition subunit and a second red light compensation value calculation subunit, the second green light calculation unit may include a second reference green light compensation value acquisition subunit and a second green light compensation value calculation subunit, and the first blue light calculation unit may include a second reference blue light compensation value acquisition subunit and a second blue light compensation value calculation subunit.

In this embodiment, the second reference red light compensation value acquisition subunit is configured to acquire the second reference red light compensation values corresponding to the at least two second reference red sub-pixels in the same row or same column with the red sub-pixel to be compensated according to the location information of the red sub-pixel to be compensated. The second reference green light compensation value acquisition subunit is configured to acquire the second reference green light compensation values corresponding to the at least two second reference green sub-pixels in the same row or same column with the green sub-pixel to be compensated according to the location information of the green sub-pixel to be compensated. The second reference blue light compensation value acquisition subunit is configured to acquire the second reference blue light compensation values corresponding to the at least two second reference blue sub-pixels in the same row or same column with the blue sub-pixel to be compensated according to the location information of the blue sub-pixel to be compensated.

In this embodiment, the second red light compensation value calculation subunit is configured to perform the tenth linear interpolation according to the second reference red light compensation values corresponding to the at least two second reference red sub-pixels in the same row or same column with the red sub-pixel to be compensated to acquire the second red light compensation value corresponding to the red sub-pixel to be compensated under the second reference grayscale. The second green light compensation value calculation subunit is configured to perform eleventh linear interpolation according to the second reference green light compensation values corresponding to the at least two second reference green sub-pixels in the same row or same column with the green sub-pixel to be compensated to acquire the second green light compensation value corresponding to the green sub-pixel to be compensated under the second reference grayscale. The second blue light compensation value calculation subunit is configured to perform twelfth linear interpolation according to the second reference blue light compensation values corresponding to the at least two second reference blue sub-pixels in the same row or same column with the blue sub-pixel to be compensated to acquire the second blue light compensation value corresponding to the blue sub-pixel to be compensated under the second reference grayscale.

The general formula of the tenth linear interpolation, the eleventh linear interpolation, and the twelfth linear interpolation is:

$$f = \frac{f2*(e1-e)}{e1-e2} + \frac{f1*(e-e2)}{e1-e2};$$

wherein, e1 and e2 denote the row count values or column count values of the two second reference red sub-pixels in the same row or same column with the red sub-pixel to be compensated, the row count values or column count values of the two second reference green sub-pixels in the same row or same column with the green sub-pixel to be compensated, or the row count values or column count values of the two second reference blue sub-pixels in the same row or same column with the blue sub-pixel to be compensated; f1 and f2 denote the second reference red light compensation values of the two second reference red sub-pixels in the same row or same column with the red sub-pixel to be compensated, the second reference green light compensation values of the two second reference green sub-pixels in the same row or same column with the green sub-pixel to be compensated, or the second reference blue light compensation values of the two second reference blue sub-pixels in the same row or same column with the blue sub-pixel to be compensated; e denotes the row count value or the column count value of the red sub-pixel to be compensated, the green sub-pixel to be compensated, or the blue sub-pixel to be compensated; and f denotes the second red light compensation value, the second green light compensation value, or the second blue light compensation value.

The third red light calculation unit is configured to perform the fourth linear interpolation according to the first red light compensation value and the second red light compensation value to acquire the target red light compensation value of the red sub-pixel to be compensated under the target grayscale. The third green light calculation unit is configured to perform the fifth linear interpolation according to the first green light compensation value and the second green light compensation value to acquire the target green light compensation value of the green sub-pixel to be compensated under the target grayscale. The third blue light calculation unit is configured to perform the sixth linear interpolation according to the first blue light compensation value and the second blue light compensation value to acquire the target blue light compensation value of the blue sub-pixel to be compensated under the target grayscale.

In this embodiment, the general formula of the fourth linear interpolation, the fifth linear interpolation, and the sixth linear interpolation may be:

$$h = \frac{h2*(g1-g)}{g1-g2} + \frac{h1*(g-g2)}{g1-g2};$$

wherein, g1 and g2 denote the first reference grayscale and the second reference grayscale; h1 and h2 denote the first red light compensation value and the second red light compensation value, the first green light compensation value and the second green light compensation value, or the first blue light compensation value and the second blue light compensation value; g denotes the target grayscale; and h denotes the target red light compensation value, the target green light compensation value, or the target blue light compensation value.

In this embodiment, the compensation module 40 may include a first compensation unit 41. The first compensation unit is configured to determine the white light compensation brightness of the pixel to be compensated under the target grayscale according to the target white light compensation value of the pixel to be compensated under the target grayscale.

In this embodiment, the compensation module 40 may include a second compensation unit. The second compensation unit is configured to determine the red light compensation brightness of the red sub-pixel to be compensated under the target grayscale, the green light compensation brightness of the green sub-pixel to be compensated under the target grayscale, and the blue light compensation brightness of the blue sub-pixel to be compensated under the target grayscale according to the target red light compensation value of the red sub-pixel to be compensated under the target grayscale, the target green light compensation value of the green sub-pixel to be compensated under the target grayscale, and the target blue light compensation value of the blue sub-pixel to be compensated under the target grayscale.

In this embodiment, relevant working principles of the compensation device 100 of the display panel can be referred to the compensation method of the display panel above and will not be iterated herein for the sake of conciseness.

The present disclosure provides the compensation method of the display panel and the compensation device thereof. The compensation method of the display panel includes following steps: determining the location information of the pixel to be compensated and acquiring the first image parameter under the first reference grayscale and the second image parameter under the second reference grayscale of the panel to be compensated; determining the target compensation value of the pixel to be compensated under the target grayscale according to the location information of the pixel to be compensated, the first image parameter, and the second image parameter; and determining the compensation brightness of the pixel to be compensated under the target grayscale according to the target compensation value. The present disclosure acquires the target compensation value of the pixel to be compensated under the target grayscale by acquiring the location information, the first image parameter, and the second image parameter of the pixel to be compensated, and then compensates the pixel to be compensated according to the target compensation value, thereby uniforming display brightness of the display panel to be compensated and improving display quality of the display panel to be compensated.

It can be understood that for a person of ordinary skill in the art, equivalent replacements or changes can be made according to the technical solution of the present disclosure and its inventive concept, and all these changes or replacements should fall within the protection scope of the claims attached to the present disclosure.

What is claimed is:

1. A compensation method of a display panel, comprising:

acquiring an original image parameter of a panel to be compensated under a target grayscale and determining location information of a pixel to be compensated of the panel to be compensated according to the original image parameter, comprising:

acquiring first location information of any one of pixels when the panel to be compensated displays white light under the target grayscale and determining the location information of the pixel to be compensated of the panel to be compensated according to the first location information;

acquiring a first image parameter under a first reference grayscale and a second image parameter under a second reference grayscale of the panel to be compensated, comprising:

acquiring a first reference white light compensation value of at least one first reference pixel when the panel to be compensated displays the white light under the first reference grayscale; and acquiring a second reference white light compensation value of at least one second reference pixel when the panel to be compensated displays the white light under the second reference grayscale;

determining a target compensation value of the pixel to be compensated under the target grayscale according to the location information of the pixel to be compensated, the first image parameter, and the second image parameter, comprising:

acquiring a first white light compensation value corresponding to the pixel to be compensated under the first reference grayscale according to the location information of the pixel to be compensated and the first reference white light compensation value;

acquiring a second white light compensation value corresponding to the pixel to be compensated under the second reference grayscale according to the location information of the pixel to be compensated and the second reference white light compensation value; and performing first linear interpolation according to the first white light compensation value and the second white light compensation value to acquire a target white light compensation value of the pixel to be compensated under the target grayscale;

wherein a formula of the first linear interpolation is:

$$y = \frac{y2*(x1-x)}{x1-x2} + \frac{y1*(x-x2)}{x1-x2};$$

wherein x1 and x2 denote the first reference grayscale and the second reference grayscale, y1 and y2 denote the first white light compensation value and the second white light compensation value, x denotes the target grayscale, and y denotes the target white light compensation value; and determining compensation brightness of the pixel to be compensated under the target grayscale according to the target white light compensation value.

2. The compensation method of the display panel according to claim 1, wherein the step of acquiring the first white light compensation value corresponding to the pixel to be compensated under the first reference grayscale according to the location information of the pixel to be compensated and the first reference white light compensation value comprises:

acquiring first reference white light compensation values corresponding to at least two first reference pixels in a same row or same column with the pixel to be compensated according to the location information of the pixel to be compensated; and performing second linear interpolation according to the first reference white light compensation values corresponding to the at least two first reference pixels in the same row or same column with the pixel to be compensated to acquire the first white light compensation value corresponding to the pixel to be compensated under the first reference grayscale;

wherein a formula of the second linear interpolation is:

$$b = \frac{b2*(a1-a)}{a1-a2} + \frac{b1*(a-a2)}{a1-a2};$$

wherein a1 and a2 denote row count values or column count values of two first reference pixels in a same row or same column with the pixel to be compensated, b1 and b2 denote the first reference white light compensation values corresponding to the two first reference pixels in the same row or same column with the pixel to be compensated, a denotes a row count value or a column count value of the pixel to be compensated, and b denotes the first white light compensation value.

3. The compensation method of the display panel according to claim 2, wherein the step of acquiring the second white light compensation value corresponding to the pixel to be compensated under the second reference grayscale according to the location information of the pixel to be compensated and the second reference white light compensation value comprises:

acquiring second reference white light compensation values corresponding to at least two second reference pixels in a same row or same column with the pixel to be compensated according to the location information of the pixel to be compensated; and performing third linear interpolation according to the second reference white light compensation values corresponding to the at least two second reference pixels in the same row or same column with the pixel to be compensated to acquire the second white light compensation value corresponding to the pixel to be compensated under the second reference grayscale;

wherein a formula of the third linear interpolation is:

$$n = \frac{n2*(m1-m)}{m1-m2} + \frac{n1*(m-m2)}{m1-m2};$$

wherein m1 and m2 denote row count values or column count values of two second reference pixels in a same row or same column with the pixel to be compensated, n1 and n2 denote the second reference white light compensation values corresponding to the two second reference pixels in the same row or same column with the pixel to be compensated, m denotes a row count value or a column count value of the pixel to be compensated, and n denotes the second white light compensation value.

4. The compensation method of the display panel according to claim 3, wherein the step of acquiring the original image parameter of the panel to be compensated under the target grayscale and determining the location information of the pixel to be compensated of the panel to be compensated according to the original image parameter comprises:

acquiring second location information of any one of red sub-pixels when the panel to be compensated displays red light under the target grayscale and determining location information of a red sub-pixel to be compensated of the panel to be compensated according to the second location information;

acquiring third location information of any one of green sub-pixels when the panel to be compensated displays green light under the target grayscale and determining location information of a green sub-pixel to be compensated of the panel to be compensated according to the third location information; and acquiring fourth location information of any one of blue sub-pixels when the panel to be compensated displays blue light under the target grayscale and determining location information of a blue sub-pixel to be compensated of the panel to be compensated according to the fourth location information.

5. The compensation method of the display panel according to claim 4, wherein the step of acquiring the first image parameter under the first reference grayscale and the second image parameter under the second reference grayscale of the panel to be compensated comprises:

acquiring a first reference red light compensation value of at least one of the red sub-pixels when the panel to be compensated displays the red light under the first reference grayscale, acquiring a first reference green light compensation value of at least one of the green sub-pixels when the panel to be compensated displays the green light under the first reference grayscale, and acquiring first reference blue light compensation values of at least two of the blue sub-pixels when the panel to be compensated displays the blue light under the first reference grayscale;

acquiring a second reference red light compensation value of at least one of the red sub-pixels when the panel to be compensated displays the red light under the second reference grayscale, acquiring a second reference green light compensation value of at least one of the green sub-pixels when the panel to be compensated displays the green light under the second reference grayscale, and acquiring a second reference blue light compensation value of at least one of the blue sub-pixels when the panel to be compensated displays the blue light under the second reference grayscale.

6. The compensation method of the display panel according to claim 5, wherein the step of determining the target compensation value of the pixel to be compensated under the target grayscale according to the location information of the pixel to be compensated, the first image parameter, and the second image parameter comprises:

acquiring a first red light compensation value corresponding to the red sub-pixel to be compensated under the first reference grayscale according to the location information of the red sub-pixel to be compensated and the first reference red light compensation value, acquiring a first green light compensation value corresponding to the green sub-pixel to be compensated under the first reference grayscale according to the location information of the green sub-pixel to be compensated and the first reference green light compensation value, and acquiring a first blue light compensation value corresponding to the blue sub-pixel to be compensated under the first reference grayscale according to the location information of the blue sub-pixel to be compensated and the first reference blue light compensation value;

acquiring a second red light compensation value corresponding to the red sub- pixel to be compensated under the second reference grayscale according to the location information of the red sub-pixel to be compensated and the second reference red light compensation value, acquiring a second green light compensation value corresponding to the green sub-pixel to be compensated under the second reference grayscale according to the location information of the green sub-pixel to be compensated and the second reference green light compensation value, and acquiring a second blue light compensation value corresponding to the blue sub-pixel to be compensated under the second reference grayscale according to the location information of the blue sub-pixel to be compensated and the second reference blue light compensation value; and performing fourth linear interpolation according to the first red light compensation value and the second red light compensation value to acquire a target red light compensation value of the red sub-pixel to be compensated under the target grayscale, performing fifth linear interpolation according to the first green light compensation value and the second green light compensation value to acquire a target green light compensation value of the green sub-pixel to be compensated under the target grayscale, and performing sixth linear interpolation according to the first blue light compensation value and the second blue light compensation value to acquire a target blue light compensation value of the blue sub-pixel to be compensated under the target grayscale.

7. The compensation method of the display panel according to claim 6, wherein the step of acquiring the first red light compensation value corresponding to the red sub-pixel to be compensated under the first reference grayscale according to the location information of the red sub-pixel to be compensated and the first reference red light compensation value, acquiring the first green light compensation value corresponding to the green sub-pixel to be compensated under the first reference grayscale according to the location information of the green sub-pixel to be compensated and the first reference green light compensation value, and acquiring the first blue light compensation value corresponding to the blue sub-pixel to be compensated under the first reference grayscale according to the location information of the blue sub-pixel to be compensated and the first reference blue light compensation value comprises:

acquiring first reference red light compensation values corresponding to at least two first reference red sub-pixels in a same row or same column with the red sub-pixel to be compensated according to the location information of the red sub-pixel to be compensated, acquiring first reference green light compensation values corresponding to at least two first reference green sub-pixels in a same row or same column with the green sub-pixel to be compensated according to the location information of the green sub-pixel to be compensated, and acquiring first reference blue light compensation values corresponding to at least two first reference blue sub-pixels in a same row or same column with the blue sub-pixel to be compensated according to the location information of the blue sub-pixel to be compensated; and performing seventh linear interpolation according to the first reference red light compensation values corresponding to the at least two first reference red sub-pixels in the same row or same column with the red sub-pixel to be compensated to acquire the first red light compensation value corresponding to the red sub-pixel to be compensated under the first reference grayscale, performing eighth linear interpolation according to the first reference green light compensation values corresponding to the at least two first reference green sub-pixels in the same row or same column with the green sub-pixel to be compensated to acquire the first green light compensation value corresponding to the green sub-pixel to be compensated under the first reference grayscale, and performing ninth linear interpolation according to the first reference blue light compensation values corresponding to the at least two first reference blue sub-pixels in the same row or same column with the blue sub-pixel to be compensated to acquire the first blue light compensation value corresponding to the blue sub-pixel to be compensated under the first reference grayscale.

* * * * *